US008449035B2

(12) United States Patent
Breitkreuz et al.

(10) Patent No.: US 8,449,035 B2
(45) Date of Patent: May 28, 2013

(54) CHAIR

(75) Inventors: Benjamin Breitkreuz, Detmold (DE); Frank Weisser, Pegnitz (DE)

(73) Assignee: Dauphin Entwicklungs- u. Beteiligungs-GmbH, Hersbruck (DE)

( * ) Notice: Subject to any disclaimer, the term of this patent is extended or adjusted under 35 U.S.C. 154(b) by 324 days.

(21) Appl. No.: 12/883,425

(22) Filed: Sep. 16, 2010

(65) Prior Publication Data

US 2011/0068613 A1 Mar. 24, 2011

(30) Foreign Application Priority Data

Sep. 18, 2009 (DE) ..... 10 2009 041 822

(51) Int. Cl.
*B60N 2/02* (2006.01)

(52) U.S. Cl.
USPC ..... 297/383; 267/353; 267/411.37

(58) Field of Classification Search
USPC ..... 297/353, 383, 440.1, 440.15, 440.2, 297/440.21, 463.1, 411.35–411.37
See application file for complete search history.

(56) References Cited

U.S. PATENT DOCUMENTS

| | | | | |
|---|---|---|---|---|
| 2,973,031 | A | 2/1961 | Cramer, Jr. | |
| 4,102,549 | A * | 7/1978 | Morrison et al. | 297/383 |
| 5,462,338 | A * | 10/1995 | Baumann | 297/411.37 |
| 5,615,926 | A * | 4/1997 | Kanai et al. | 297/411.27 |
| 5,839,784 | A * | 11/1998 | Breen | 297/383 |
| 5,944,387 | A * | 8/1999 | Stumpf | 297/411.37 |
| 6,659,560 | B1 * | 12/2003 | Chi | 297/383 |
| 7,380,884 | B2 * | 6/2008 | Matern et al. | 297/374 |
| 7,806,481 | B2 * | 10/2010 | Eberlein | 297/411.37 |
| 8,104,838 | B2 * | 1/2012 | Tsai | 297/411.37 |

FOREIGN PATENT DOCUMENTS

| | | |
|---|---|---|
| DE | 295 02 276 U1 | 5/1995 |
| DE | 103 12 446 B3 | 8/2004 |
| GB | 2 356 805 | 6/2001 |

* cited by examiner

*Primary Examiner* — Laurie Cranmer
(74) *Attorney, Agent, or Firm* — McGlew and Tuttle, P.C.

(57) ABSTRACT

A chair, in particular an office chair, comprises a pedestal for supporting relative to the floor, a seat support connected to the pedestal, a seat arranged on the seat support, and a backrest support supporting a backrest, which is detachably connected to the seat support.

20 Claims, 4 Drawing Sheets

CHAIR

FIELD OF THE INVENTION

The invention relates to a chair comprising a backrest, in particular an office chair.

BACKGROUND OF THE INVENTION

Chairs with backrests have been known for a long time. As said known chairs are extremely bulky in the assembled state, the latter are generally supplied in a partly assembled form. The chairs are then assembled on site. This often requires a high degree of manual skill and is therefore generally associated with certain difficulties. A tool is also required for this. The disassembly is often difficult as well.

SUMMARY OF THE INVENTION

The problem addressed by the invention is to provide a chair, the backrest support or backrest of which can be attached onto the seat support without tools in a simple manner. Furthermore, the backrest support should be assembled without play on the seat support, so that the backrest support does not wobble. The backrest support or the backrest should also be able to be disassembled easily.

Said problem is solved according to the invention by a chair, in particular an office chair, comprising a pedestal for supporting relative to the floor, a seat support in connection with the pedestal, a seat arranged on the seat support and a backrest support supporting a backrest, which backrest support is connected detachably to the seat support. The main concept of the invention is that the backrest support can be connected detachably to the seat support. The backrest can thus also be removed from the seat support again easily, so that the chair can then be transported easily without taking up a large amount of space. The ability to be dismantled is not absolutely necessary.

In the following with reference to the attached drawing a preferred embodiment of the invention is described by way of example.

DESCRIPTION OF THE PREFERRED EMBODIMENT

Figure 1:
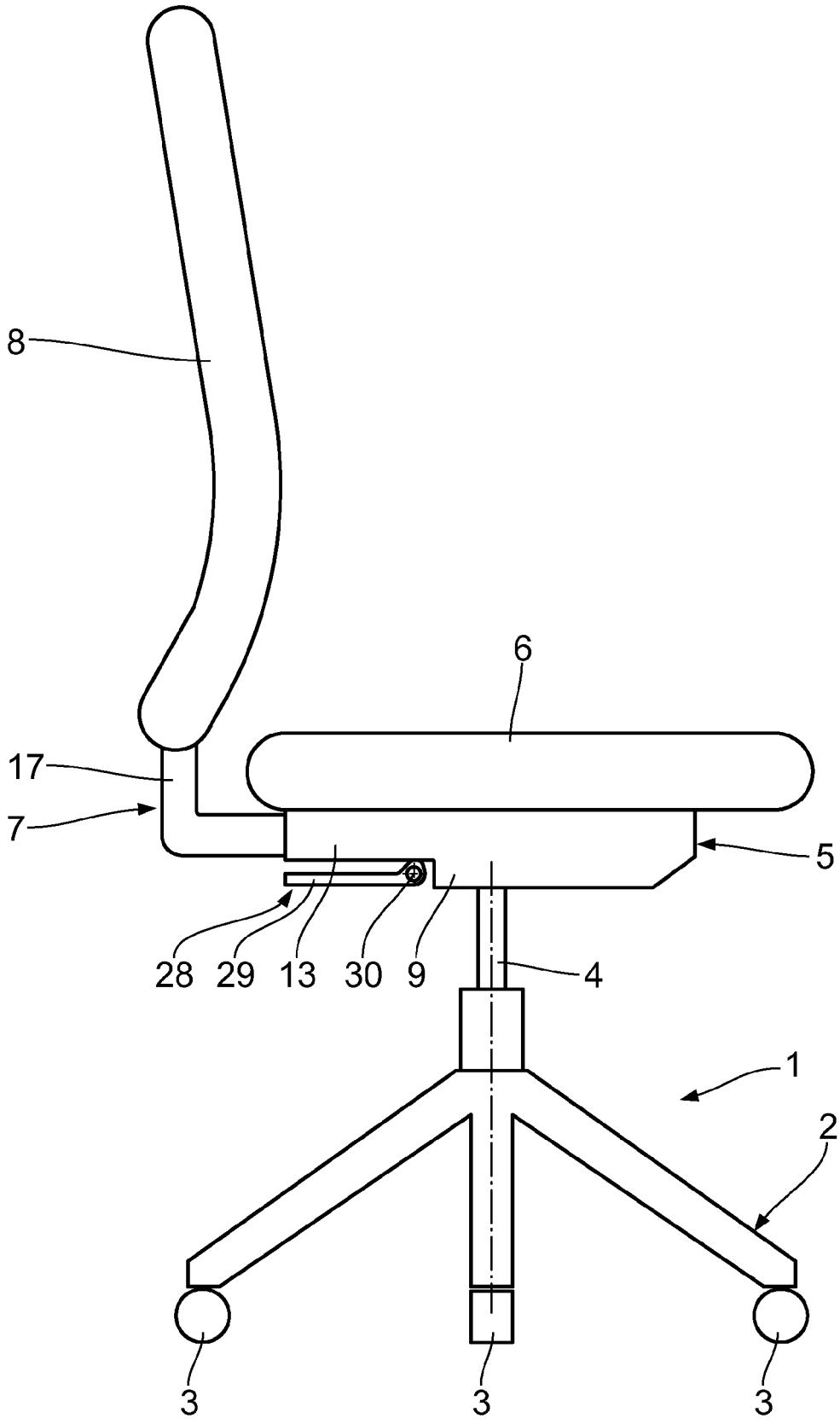
FIG. 1 shows a chair according to the invention in perspective view.

FIG. 1 shows an office chair as a whole. The office chair comprises a chair support 1. The chair support 1 comprises a pedestal 2, which is supported by several rollers 3 on a not shown surface, such as a floor. A height-adjustable chair column 4 running in vertical direction is attached to the floor support 2, on the upper end of which column a seat support 5 is secured. On the seat support 5 a seat height adjusting device (not shown) is provided, which is used for the height adjustment of the chair column 4.

On the seat support 5 a seat 6 is supported. The seat 6 provides a sitting area which is comfortable to sit on. The seat support 5 and the seat 6 can alternatively be designed in one piece.

On the seat support 5 at the rear a backrest support 7 projecting up from the latter is attached, onto which a backrest 8 is secured. The backrest 8 provides a bearing surface for the back of the person sitting on the seat surface. Armrests can also be secured onto the seat support 5 or onto the backrest 8 or onto the seat 6.

In the following the securing of the backrest 8 or the backrest support 7 onto the seat support 5 is described in more detail. The seat support 5 has a substantially central bearing area 9, in which the chair column 4 is mounted by a corresponding bearing device (not shown). Behind the bearing area 9 the seat support 5 comprises an elongated, stable backrest support mount 10, which is used for holding or partly mounting the backrest support 7. The backrest support mount 10 is designed shaft-like and extends substantially horizontally. It is designed as a rectangular profile and is open at the ends respectively. The walls 11, 12, 13 are thus even and plate-like respectively. The backrest support mount 10 is formed by an upper wall 11, a lower wall 12 opposite the latter and two connecting side walls 13 opposite one another. The upper and lower wall 11, 12 extend respectively substantially horizontally, whilst the side walls 13 are essentially vertical. Their middle longitudinal axis is substantially horizontal. The backrest support mount 10 is open at the front and rear, whereby the opening to the front is not absolutely necessary. At the rear the backrest support mount 10 has an insertion opening 14, which is accessible from the outside. Opposite the insertion opening 14 for the backrest support mount 10 a front connecting opening 15 is provided, which opens inwardly into the bearing area 9. The connecting opening 15 is optional.

The backrest support 7 has an angular form. It comprises a straight insertion section 16 and a straight holding section 17 which is essentially perpendicular thereto, onto which the backrest 8 is secured. The backrest support 7 essentially has a uniform, rectangular cross section. A circular segment or circular or oval cross section which is uniform or tapers conically is also possible. The cross section of the backrest support 7 corresponds substantially to the corresponding inner transverse dimensions of the backrest support mount 10, so that the insertion section 16 can be introduced into the backrest support mount 10 and can be secured there reliably. In the assembled state of the office chair the walls 11, 12, 13 of the backrest support mount 10 are arranged immediately adjacent to the corresponding side surfaces of the insertion section 16.

On the seat support 5 a manually operable securing device 18 is provided for securing the backrest 8 or the backrest support 7 onto the seat support 5, which lies in the vertical symmetrical plane of the office chair and is designed substantially symmetrically to the latter. The securing device 18 is arranged adjacent to the connecting opening 15 in the front section of the backrest support mount 10. It comprises a one-piece stable securing body 19, which is displaceably mounted in the backrest support mount 10. The securing body 19 comprises a connecting pin 20 and an end-side locking element 21 connected securely therewith. The connecting pin 20 is designed elongated and has central longitudinal axis 22. It has a round cross section. The locking-element 21 however is designed plate-like. It projects laterally relative to the connecting pin 20 and has an elongated substantially rectangular design, wherein its opposite longitudinal ends 23 are designed in the form of a semi-circle.

For positioning the securing body 19 in the backrest support mount 10 two mutually opposite bearing openings 24, 25 are provided. The connecting pin 20 extends vertically, whereby the locking element 21 is attached at the top to the connecting pin 20. The bearing opening 24 is formed in the upper wall 11 of the backrest support mount 10 adjacent to the connecting opening 15. Its shape and size correspond substantially to the shape of the locking element 21 and its horizontal surface dimensions. The bearing opening 24 thus comprises two mutually opposite semi-circular ends 26, which face the respective side walls 13. The vertical thickness of the locking element 21 is greater than the vertical thickness of the upper wall 11. The bearing opening 25 is formed in the lower wall 12 adjacent to the connecting opening 15. Its shape and size corresponds substantially to the cross section of the connecting pin 20. The locking element 21 is located in the upper bearing opening 24, whilst the connecting pin 20 passes vertically through the backrest support mount 10 and also passes through the bearing opening 25.

On the connecting pin 20 a helical compression spring 27 is arranged which surrounds the connecting pin 20 in a helical manner. The helical compression spring 27 is supported at the bottom on the inner side on the lower wall 12 and at the top on the lower side of the locking element 21. It thus pushes the movable locking element 21 upwards or outwards.

The lower end of the connecting pin 20, the end facing away from the locking element 21, is located underneath the lower wall 12. On the lower end of the connecting pin 20 a one-piece actuating lever 28 is attached, which is a component of the securing device 18. The actuating lever 28 comprises an actuating handle 29 and an actuating cam 30 connected securely to the latter. The actuating cam 30 has a curved cam projection 33, which projects radially from the otherwise essentially cylindrical cam basic body. The actuating cam 30 is penetrated axially by an elongated bearing opening 31 with a circular cross section. The bearing opening 31 extends along the actuating cam 30. In the bearing opening 31 a cylindrical bearing pin 32 is arranged, which is mounted on the lower end of the connecting pin 20 and is also a component of the securing device 18. The bearing pin 32 has a central longitudinal axis 34, which defines a bearing axis. The central longitudinal axis 34 is substantially horizontal. Alternatively, the locking can also be performed by rotational locking or a bayonet closure. In the case of a bayonet closure frictional locking is possible, optionally via a dead centre.

Adjacent to the front end of the insertion section 16 at the top in the insertion section 16 a locking recess 35 is provided, which in the assembled state of the office chair faces the upper wall 11. The locking recess 35 is open towards the top. The shape and size of the locking recess 35 correspond substantially to the shape of the locking element 21 and its horizontal surface dimensions. The locking recess 35 has a limited, vertical depth which is between 1 mm and 5 mm, preferably between 1.5 mm and 3.5 mm. It is delimited laterally by the material of the insertion section 16 which forms a vertical, peripherally closed locking wall.

Centrally in the insertion section 16 from the front end of the insertion section 16 a narrow, straight opening 36 extends into the locking recess 35. The opening 36 passes completely through the insertion section 16 in vertical direction and divides the locking recess 35 essentially into two halves. It extends substantially up to the rear longitudinal side 37 of the locking recess 35. Its width corresponds substantially to the diameter of the connecting pin 20. The slot-like opening 36, which is open towards the seat support 5, is not necessarily required for the functioning of the invention. Furthermore, it is possible alternatively to provide the slot-like opening 36 on the seat support 5 and secure the actuating handle 29 to the backrest support 7.

On the insertion section 16 at least one detent element 38 is provided. In the described exemplary embodiment here two detent elements 38 are provided. The detent elements 38 are designed identically and are located laterally at the bottom in the insertion section 16. They comprise respectively a strip-like, spring support element 39, on the free end of which a downwards projection detent nose 40 is provided. Each detent nose 40 has a planar, vertical holding surface 41, which faces the rear. The detent elements 38 are used for the further securing of the backrest 8 or the backrest support 7 onto the seat support 5. They are provided at the front on the insertion section 16.

In the following the attachment of the backrest 8 or the backrest support 7 onto the seat support 5 and the securing of the backrest support 7 onto the seat support 5 are described in more detail. The insertion section 16 is inserted along a horizontal pushing direction 42 via the rear insertion opening 14 into the backrest support mount 10. In this case the holding section 17 extends from the insertion section 16 upwards and the actuating handle 29 runs from the bearing pin 32 almost vertically downwards. A flat head section 44 of the actuating cam 30, which at an angle of about 90° to the central longitudinal axis 34 is spaced apart at an angle from the cam projection 33, in this release position of the actuating handle 29 lies externally on the lower wall 12. The head section 44 has a much smaller radial thickness than the cam projection 33. The helical compression spring 27 pushes the locking element 21 vertically upwards, so that the lower side of the locking element 21 is aligned approximately with the lower side of the upper wall 11. Since the locking element 21 is thicker than the upper wall 11, the locking element 21 projects upwards out of the bearing opening 24 relative to the upper wall 11. The locking element 21 thus does not project into the backrest support mount 10, so that the latter is virtually free and the insertion section 16 can be pushed in up to its intended position into the backrest support mount 10. The securing body 19 or the locking-element 21 is thus located in its uppermost position, which is a release position for the backrest support 7 or the insertion section 16.

Figure 2:
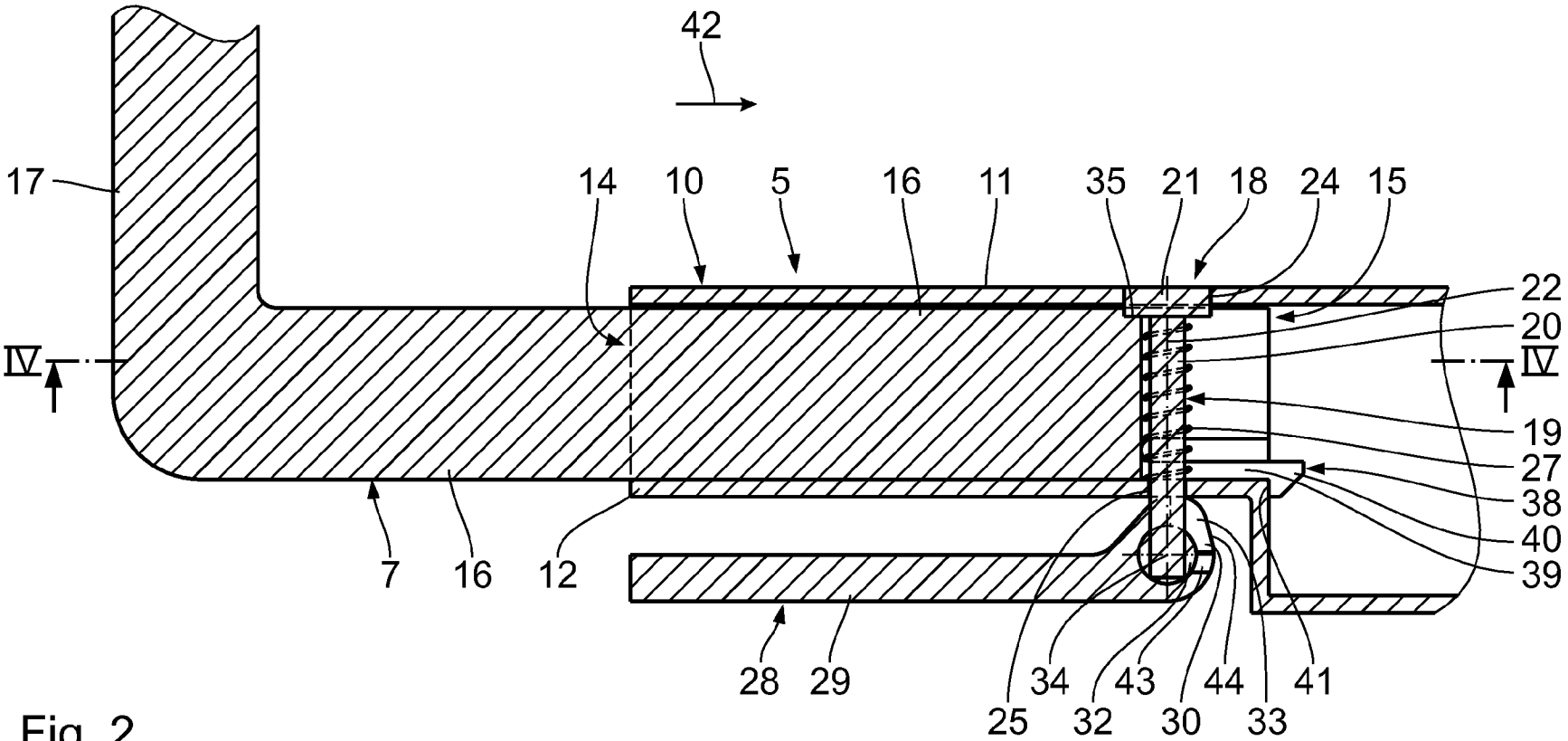
FIG. 2 shows a vertical section, which shows in an enlarged form the connection according to the invention between the seat support and backrest support of the chair shown in FIG. 1.
Figure 3:
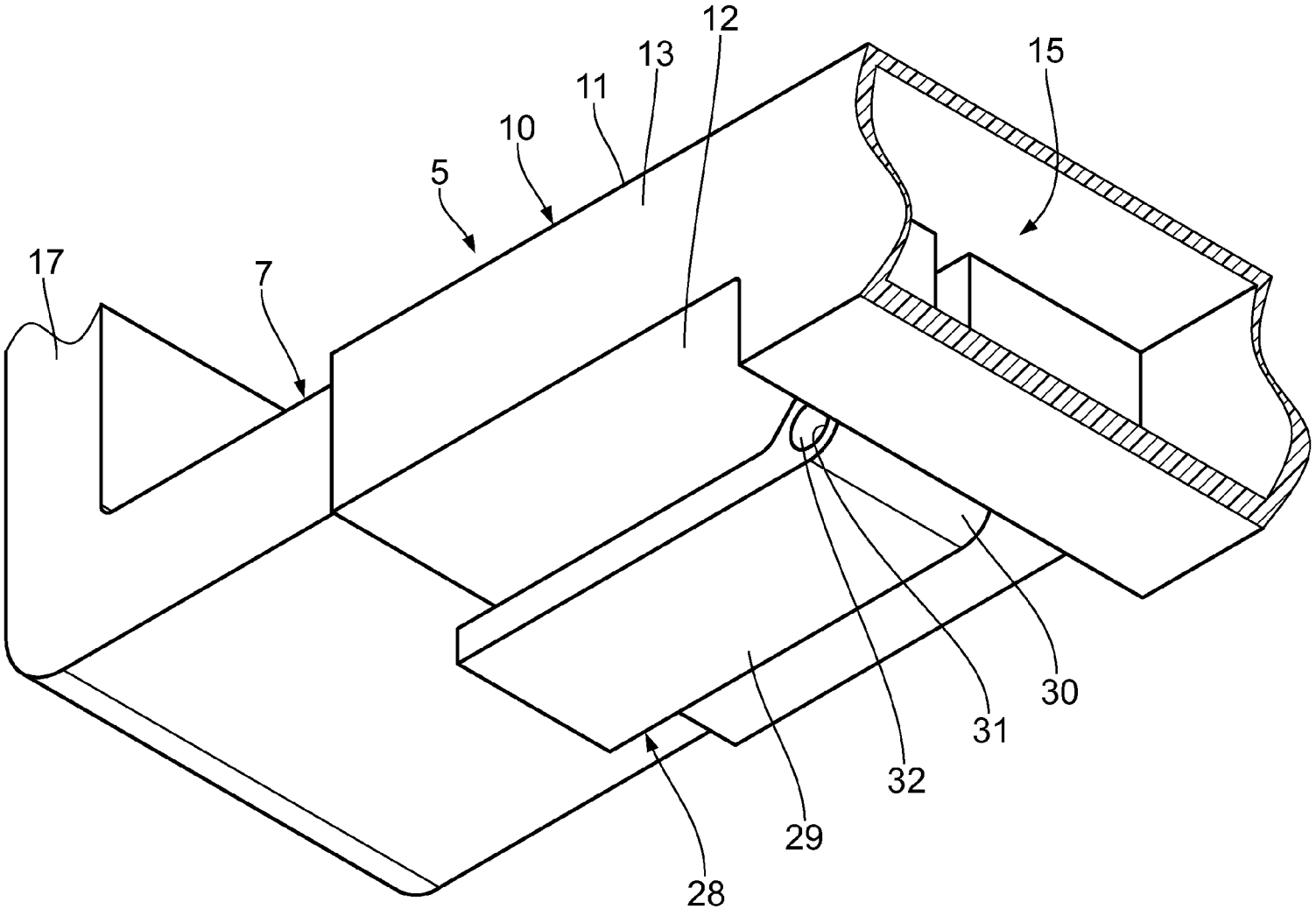
FIG. 3 shows a perspective view illustrating the connection according to FIG. 2.
Figure 4:
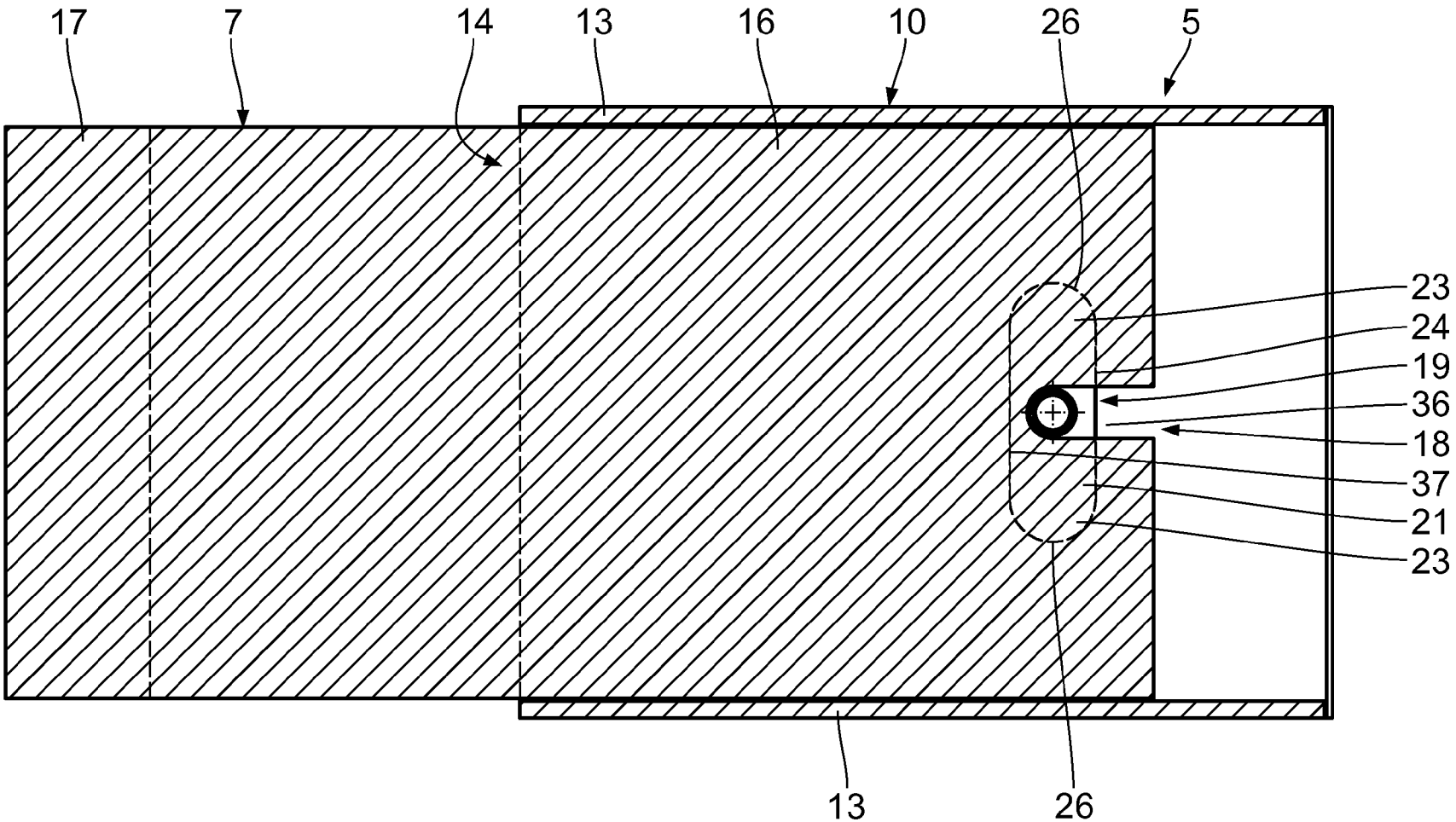
FIG. 4 shows a horizontal section according to the section line IV-IV shown in FIG. 2.

The end position of the backrest support 7 is shown particularly well in FIG. 2. When said end position is reached, firstly the backrest support mount 7 is secured to the seat support 5 via the detent elements 38. The detent noses 40 are resilient or spring automatically into a lower locking position, in which they are then in locking connection with the seat support 5. It is not absolutely necessary to perform the locking, but this assists with the correct assembly. As shown in FIG. 2, the holding surfaces 41 are then adjacent to a corresponding vertical wall of the seat support 5, so that by means of the interconnection between the holding surfaces 41 and the vertical wall the insertion section 16 cannot be pulled out in a direction opposite the insertion direction 42. The detent noses 40 can however also engage alternatively in at least one detent recess in the seat support 5. The detent elements 38 engage audibly into their locking position. The mechanic thus receives confirmation that the end position of the backrest support 7 has been reached and that the locking has been successful. The detent element 38 simultaneously serves as a removal lock when the eccentric is incorrectly closed and also as a user safeguard during faulty clamping of the eccentric.

The securing device 18 is responsible for the additional securing of the backrest 8 or the backrest support 7 onto the seat support 5. For this the actuating lever 28 has to be activated manually via the actuating handle 29. It has to be rotated according to FIG. 2 clockwise from its release position into the essentially horizontal locking position shown in FIG. 2 about the central longitudinal axis 34 of the bearing pin 32, whereby also the actuating cam 30 is rotated accordingly. During the rotation the cam projection 33 is crossed over, so that the locking element 21 is pulled via the connecting pin 20 axially against the force of the helical compression spring 27 vertically downwards into the locking recess 35 lying directly below in the insertion section 16. The locking wall of the locking recess 35 is aligned here substantially with the side wall of the bearing opening 24. Furthermore, the upper side of the locking element 21 is aligned with the outside of the upper wall 11.

In the lower locking position of the locking element 21 the locking element 21 engages in a positive manner with the locking recess 35 and lies flat on the floor. Furthermore, the locking element 21 is located in the bearing opening 24. The side surfaces of the locking element 21 are thus immediately adjacent to the vertical locking wall of the locking recess 35 and the vertical side wall of the bearing opening 24, which ensures the locking of the backrest support 7 and prevents a relative movement of the backrest support 7 relative to the seat support 5. The backrest support 7 is fixed by the form-fit engagement both in insertion direction 42 and against the latter. The locking element 21 acts as a bolt between the seat support 5 and the backrest support 7, in that it is in form-fit engagement both with the insertion section 16 and the seat support 5.

The locking position of the actuating lever 28 is an beyond dead centre position. This position is stable and can only be left by the application of an external force. The actuating handle 29 is pivoted away for reaching the locking position slightly over the effective area of the cam projection 33. In the final position of the insertion section 16 the connecting pin 20 penetrates the opening 36 preferably bears on the rear end.

It is essential that in the locking-position corresponding walls of the bearing opening 24 and the locking recess 35 are assigned to the longitudinal sides of the locking element 21 running perpendicular to the pushing-in direction, in order to secure the backrest support 7 in and against the pushing-in direction 42.

For the removal of the backrest 8 or the backrest support 7 from the seat support 5 the actuating handle 29 is pivoted downwards anticlockwise, whereby also the actuating cam 30 is pivoted again accordingly. In order to move the actuating lever 28 out of its beyond dead centre position, initially an increased, external, manual force needs to be applied. The cam projection 33 is moved past again. The helical compression spring 27 can then push the locking-element 21 upwards back out of the locking recess 35, so that the locking-element 21 can be disconnected from the locking recess 35.

Afterwards the detent noses 40 are pivoted manually upwards, so that there is no longer a locking connection between the backrest support 7 and the seat support 5. It is also possible to arrange the locking device 38 differently, so that the pivoting of the catches takes place laterally. The backrest support 7 can then be pulled opposite the insertion direction 42 back out of the backrest support mount 10.

No tools are required either for the assembly and disassembly of the backrest support 7. The backrest support 7 can thus be mounted without tools on the seat support 5 and can also be disassembled from the latter again without tools. This makes the assembly and disassembly particularly easy and fast. The implementation of the assembly and disassembly may, as described herein, take place tool-free or using simple tools, so that no accidental operation is possible. A pin, e.g. having a diameter of 4 mm, or a paper clip, too, may be considered simple tools.

According to an alternative embodiment the insertion section 16 is hollow. It can be designed for example as a rectangular profile. The insertion section thus surrounds the backrest support mount. In this embodiment the locking position of the securing body 19 is in an upper position, whilst the release position of the securing body 19 is in a lower position. This is thus opposite to embodiment described above.

The invention has been described here in relation to an office chair. An office chair of this kind can for example also have a known synchronous mechanism. The invention can also be used in other chairs with a backrest.

The backrest support mount 10 can also be attached as a separate element onto the seat support 5.

In the description the terms "front" and "rear" or the like have been used throughout. Said terms relate to the direction of view of a person sitting normally on the chair with the chair set up correctly, which is shown in FIG. 1. The actuating lever 28 is located accordingly for example in front of the holding section 17. The terms "horizontal" and "vertical" or the like have been used accordingly.

Instead of a helical compression spring 27 also other spring or resilient elements can be used. For example, blocks made from a flexible, elastic material can be used.

The detent elements 38 can also be provided on the seat support 5 and can then engage in a suitable recess in the backrest support 7.

What is claimed is:

1. A chair, in particular an office chair, comprising:

a pedestal for supporting relative to the floor;

a seat support in connection with the pedestal;

a seat arranged on the seat support;

a backrest support supporting a backrest, which backrest support is connected detachably to the seat support, said seat support comprising a backrest support mount for holding the backrest support, whereby the backrest support is pushable into the backrest support mount;

a securing device for locally securing the backrest support on the seat support, wherein the securing device comprises a manually actuable securing body, said securing body being mounted on the seat support and said securing body being movable between a locking position and a release position, said securing body comprising a locking element for locking interaction with the backrest support, said locking element engaging in the locking position in the backrest support, said locking element engaging, in the locking position, in the backrest support in a positive manner, said locking element having a plate-like design, wherein a bearing opening is formed in an upper wall of the backrest support mount, said bearing opening having a shape and a size that corresponds substantially to a shape of the locking element and surface dimensions of the locking element.

2. A chair according to claim 1, wherein the backrest support is secured in said locking position by at least one detent element relative to the seat support, wherein the at least one detent element is provided on one of the backrest support and the seat support.

3. A chair according to claim 1, wherein the backrest support is secured in the locking position by at least one detent element relative to the seat support, wherein the at least one detent element comprises a detent nose, wherein the at least one detent element is provided on one of the backrest support and the seat support.

4. A chair according to claim 1, wherein on the securing body a spring element acts for forcing the locking element into the release position.

5. A chair according to claim 1, wherein the securing device comprises an actuating lever, which is articulated onto the securing body for the displacement thereof.

6. A chair according to claim 5, wherein on the actuating lever an activating cam is provided, whereby the actuating lever is located in the locking position of the securing body in a stable beyond dead center position.

7. A chair according claim 1, wherein the backrest support is at least one of connectable to and detachable from the seat support without using a tool.

8. A chair according to claim 1, wherein in the locking position of the locking element the locking element functions as a lock between the seat support and the backrest support, said locking element being in engagement with both an insertion section of the backrest support and the seat support in a positive manner.

9. A chair according to claim 1, wherein the locking element has side surfaces, wherein in the locking position of the locking element the side surfaces of the locking element directly adjacent to a vertical locking wall of a locking recess are arranged in the insertion section and a vertical side wall of the bearing opening, which ensures a locking of the backrest support and prevents a relative movement of the backrest support relative to the seat support.

10. A chair according to claim 1, wherein the locking element has side surfaces, wherein in the locking position of the locking element the side surfaces of the locking element directly adjacent to a vertical locking wall of a locking recess are arranged in the insertion section and a vertical side wall of the bearing opening, which ensures a locking of the backrest support and prevents a relative movement of the backrest support relative to the seat support, whereby the shape and size of the locking recess correspond substantially to the shape of the locking element and surface dimensions of the locking element.

11. An office chair comprising:

a pedestal for supporting relative to the floor;

a seat support in connection with the pedestal;

a seat arranged on the seat support;

a backrest support supporting a backrest, said backrest support being detachably connected to the seat support; and a securing device for locally securing the backrest support on the seat support, wherein the securing device comprises a manually actuable securing body, wherein the securing body comprises a connecting pin and an end-side locking element connected securely therewith, wherein the locking element is provided for locking interaction with the backrest support.

12. A chair according to claim 11, wherein the connecting pin has an elongated shape with a central longitudinal axis.

13. A chair according to claim 11, wherein the connecting pin has a round cross section oriented perpendicular to a central longitudinal axis.

14. A chair according to claim 11, wherein the locking element has a plate-like design, wherein the locking element projects laterally relative to the connecting pin and has an elongated substantially rectangular design.

15. A chair according to claim 11, wherein the seat support comprises a backrest support mount for holding the backrest support, whereby the backrest support is pushable into the backrest support mount, wherein a bearing opening is formed in an upper wall of the backrest support mount, said bearing opening having a shape and size corresponding substantially to a shape of the locking element and surface dimensions of said locking element, wherein a vertical thickness of the locking element is greater than a vertical thickness of the upper wall.

16. A chair according to claim 11, wherein a second bearing opening is formed in a lower wall adjacent to a connecting opening, wherein a shape and a size of the second bearing opening correspond substantially to a cross section of the connecting pin.

17. A chair according to claim 11, wherein the locking element is located in an upper bearing, with the connecting pin extending vertically through the backrest support mount and said connecting pin extending through the bearing opening.

18. A chair, comprising:

a pedestal;

a seat support connected to said pedestal, said seat support comprising a backrest support mount;

a seat arranged on said seat support;

a backrest;

a backrest support supporting said backrest, said backrest support being detachably connected to said seat support, said backrest support being detachably connected to said backrest support mount;

a securing device comprising a connecting pin and a planar lock element connected at one end of said connecting pin, said connecting pin being movable between a locked position and a non-locked position, said planar lock element engaging said backrest support with said connecting pin in said locked position such that said planar lock element fixes at least a portion of said backrest support in said backrest support mount, said planar lock element being located at a spaced location from said backrest support with said connecting pin in said non-locked position.

19. A chair in accordance with claim 18, wherein said backrest support mount comprises an upper wall, said upper wall having a positive lock bearing opening, said backrest support having a backrest support positive locking recess, said positive lock bearing opening and said backrest support positive locking recess having a shape and a size that corresponds substantially to a shape of the locking element, wherein at least a portion of said lock element is arranged in said positive lock bearing opening and at least another portion of said lock element is arranged in said backrest support positive locking recess with said connecting pin in said locked position such that said positive lock bearing opening, said backrest support positive locking recess and said lock element form a positive lock connection, said backrest support being fixed in said backrest support mount via said positive lock connection with said connecting pin in said locked position.

20. A chair in accordance with claim 19, further comprising:

an actuating lever connected to said connecting pin and said lock element, said actuating lever being mounted for movement such that said actuating lever is movable from an actuating lever locked position to an actuating lever unlocked position, wherein movement of said actuating lever between said actuating lever unlocked position and said actuating lever locked position moves said connecting pin between said locked position and said non-locking position; and a spring extending about said connecting pin, said spring being in a compressed state with said actuating lever in said actuating lever locked position and with said connecting pin in said locked position, said spring being in an uncompressed state with said actuating lever in said actuating lever unlocked position and with said connecting pin in said non-locked position.

* * * * *